US006559603B2

(12) United States Patent
Iwami

(10) Patent No.: US 6,559,603 B2
(45) **Date of Patent: *May 6, 2003**

(54) DRIVING APPARATUS FOR DRIVING DISPLAY PANEL

(75) Inventor: Takashi Iwami, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/948,937

(22) Filed: Sep. 10, 2001

(65) Prior Publication Data

US 2002/0047575 A1 Apr. 25, 2002

(30) Foreign Application Priority Data

Sep. 8, 2000 (JP) ..... 2000-273205
Jun. 29, 2001 (JP) ..... 2001-197797

(51) Int. Cl.[7] ..... G09G 3/10

(52) U.S. Cl. ..... 315/169.1; 315/169.3; 345/55; 345/204; 345/214

(58) Field of Search ..... 315/169.3, 169.1, 315/169.4; 345/55, 60, 67, 68, 80, 94, 214, 212, 204, 211

(56) References Cited

U.S. PATENT DOCUMENTS 6,072,447 A * 6/2000 Noborio ..... 345/60
6,304,038 B1 * 10/2001 Ide et al. ..... 315/169.1
6,333,738 B1 * 12/2001 Ide ..... 315/169.3
6,337,763 B1 * 1/2002 Berkey et al. ..... 359/161

* cited by examiner

*Primary Examiner*—Haissa Philogene
*Assistant Examiner*—Ephrem Alemu
(74) *Attorney, Agent, or Firm*—Sughrue Mion, PLLC

(57) ABSTRACT

A display panel drive apparatus can reduce power consumption upon writing pixel data. The display panel drive apparatus reduces a resonance amplitude of the resonance pulse voltage source carrying the generation of the pixel data pulse while keeping maximum potential level thereof, when at least two of the supplied pixel data neighboring each other in column direction assume the same logic value as each other.

11 Claims, 10 Drawing Sheets

DRIVING APPARATUS FOR DRIVING DISPLAY PANEL

BACKGROUND OF THE INVENTION

1. Field of the Invention

The present invention relates to an driving apparatus for driving a flat display panel such as an AC drive type plasma or an electroluminescence display panel.

2. Description of the Related Art

There have been developed a flat display panel constituted by capacitive light-emitting elements such as plasma display panel (PDP) or electroluminescence diaply panel (ELP).

FIG. 1 shows a general structure of a plasma display apparatus including a PDP as such flat panel.

In FIG. 1, a PDP 10 includes row electrodes $Y_1$ through $Y_n$ and $X_1$ through $X_n$ the corresponding ones of which constitute row electrode pairs each corresponding to each one of $1^{st}$ to n-th rows of a single frame or screen. The PDP further includes column electrodes $Z_1$ through Zm respectively corresponding to the $1^{st}$ to m-th columns of the single frame. The column electrodes Z intersect the row electrode pairs X and Y and sandwich dielectric layers (not shown) and discharge cavities (not shown) together with the row electrode pairs X and Y so that a discharge cell is formed at each intersection between one pair (X, Y) of the row electrode pairs and one of the column electrode Z.

In this instance, it is to be understood that each of the discharge cells takes either one of two states of "light-emitting" and "non-light-emitting". In other words, the discharge cell can display merely two gradations of the lowest brightness (non-light-emitting state) and of the highest brightness (light-emitting state).

A drive apparatus 100 for driving the PDP 10 therefore employs the so-called sub-field method in driving the PDP 10 so as to realize an intermediate gradation of brightness in response to an input video signal.

In the sub-filed method, each picture element carried by the input video signal is converted into a video data of N bits. One field or frame of contained by the video signal is divided into N pieces of sub-fields the respective sub-fields correspond to the respective digits of one of the video data. An appropriate number of discharge times is allotted to a sub-field in accordance with a weight given to the sub-field. The respective discharge cavities are triggered so as to initiate the discharge action so as to constitute the respective sub-fields. Each picture element takes a brightness of an intermediate gradation corresponding to a sum of the respective number of discharge times each having occurred within the respective sub-fields within one field or frame.

A selective erasure address method is known as an example of the method for actually driving the PDP by using the subfield method described above.

FIG. 2 is a diagram showing timings of the application of various driving pulses which are applied to the column electrodes and row electrodes of the PDP 10 by the driver 100 in a subfield when the gray-scale drive is performed based on the selective erasure address method.

First, the driver 100 applies reset pulses $RP_X$ having a negative polarity simultaneously to the respective row electrodes $X_1$ through $X_n$ and applies reset pulses $RP_Y$ having a positive polarity simultaneously to the respective row electrodes $Y_1$ through $Y_n$ (simultaneous resetting step Rc).

In accordance with application of the reset pulses $RP_X$ and $RP_Y$, all of the discharge cells of PDP 10 are discharged to reset, and a predetermined amount of wall charge is uniformly formed in the respective discharge cells.

By this process, all of the discharge cells in PDP 10 are initialized to a "light emitting cell" state.

Next, the driver 100 converts the incoming video signal to pixel data of 8 bits, for example. The driver 100 separates respective bits of the 8 bit pixel data for each of the bit digits, to obtain pixel data bits, and generates pixel data pulses having a pulse voltage in accordance with the logical level (or value) of the corresponding bit. For example, the driver 100 generates a pixel data pulse DP which has a high voltage when logical level of the pixel data bit mentioned above is "1" and a low voltage (0 volt) when the logical level of the pixel data bit is "0". Further, as shown in FIG. 2 the driver 100 applies to the column electrodes $Z_1$ through $Z_m$ successively each of m groups of pixel data pulses $DP_{11\text{-}1m}$, $DP_{21\text{-}2m}$, $DP_{31\text{-}3m}$, . . . $DP_{n1\text{-}nm}$ which are formed by grouping the pixel data pulses $DP_{11}$–$DP_{nm}$ of one screen (n rows and m columns) for each of display lines (m lines). Furthermore, the driver 100 generates a scan pulse SP as shown in FIG. 2 in synchronism with an application timing of each of the respective pixel data pulse group DP and applies it successively to the row electrodes $Y_1$ through $Y_n$ (pixel data writing process Wc). With this operation, there causes discharge (selective erasure discharge) only at the discharge cell at an intersecting portion of a "row" applied with the scan pulse SP and "column" applied with the pixel data pulse having high voltage, so that wall charge which has been remaining in the discharge cell is selectively erased. With this process, the discharge cells which have been initialized to the "light emitting cell" state in the simultaneous resetting step mentioned above is shifted to a "no light emitting cell" state. Meanwhile, the selective erasure discharge is not caused in the discharge cells formed to cross the "rows" and "columns" in which the pixel data pulse having low voltage is applied while the scan pulse SP is applied, and the state of being initialized at the simultaneous resetting step Rc, that is, the state of "light emitting cell" is maintained.

Next, the driver 100 repetitively applies sustaining pulses $IP_X$ having a positive polarity as shown in FIG. 2 to the row electrodes $X_1$ through $X_n$, and repetitively applies sustaining pulses $IP_Y$ having a positive polarity as shown in FIG. 2 to the row electrodes $Y_1$ through $Y_n$ in the periods when the sustaining pulses $IP_X$ is not applied (light emission sustaining step Ic).

In this process, only the discharge cell at which wall charge is kept remaining, that is, the discharge cell brought into the "light emitting cell" state, carries out a discharge (sustaining discharge) each time the sustaining pulses $IP_X$ and $IP_Y$ are applied alternately. That is, only the discharge cell set to the "light emitting cell" state in the pixel data writing step Wc mentioned above, repeats the light emission in accordance with sustaining discharge to the number of times corresponding to the weight of the respective subfield, and maintains the light emitting state. The number of times of the application of the sustaining pulses $IP_X$ and $IP_Y$ is previously set in accordance with the weight of the respective subfield.

Then, the driver 100 applies an erasure pulse EP as shown in FIG. 2 to the row electrodes $X_1$ to $X_n$ (erasing step E). With this step, erasing discharge takes place simultaneously in all of the discharge cells, to extinguish the wall charge which has been remaining in each discharge cell.

An intermediate brightness corresponding to a video signal is obtained visually, by repeating the sequence of steps described above in a plurality of number of times in one field.

However, in the case of capacitive display panels such as a PDP and ELP, with regard to the pixel data pulses which are applied to the column electrodes in order to write the pixel data, each time the data of each row is written the charge and discharge must be executed also in other rows in which the writing of data is not performed. Furthermore, capacitive charge and discharge between neighboring column electrodes must also be performed. Therefore, a problem has been encountered that the electric consumption during the writing of pixel data is large.

OBJECT AND SUMMARY OF THE INVENTION

An object of the present invention is therefore to provide a drive apparatus of a display panel which is able to reduce the electric power consumed during the writing of pixel data.

The drive apparatus of a display panel according to the present invention is a drive apparatus that applies pixel data pulses each having a pulse voltage corresponding to pixel data based on a video signal, to each of column electrodes of a display panel in which capacitive light emitting cells are formed at intersecting portions of a plurality of row electrodes that form the rows of the screen and a plurality of column electrodes that form the columns of the screen. The drive apparatus comprises: a power supply circuit that generates a resonation pulse power supply potential which has a resonation amplitude of which the maximum potential level assumes a predetermined first potential, and applies it on a power supply line; and a pixel data pulse generating circuit that produces said pixel data pulse on said column electrodes by connecting said column electrodes to said power supply line in accordance with said pixel data, wherein said power supply circuit is adapted to reduce said resonation amplitude when at least two pixel data which are adjoining in a column direction have the same logical level while maintaining said first potential of said resonation pulse power supply potential.

DETAILED DESCRIPTION OF THE PREFERRED EMBODIMENTS

Figure 3:
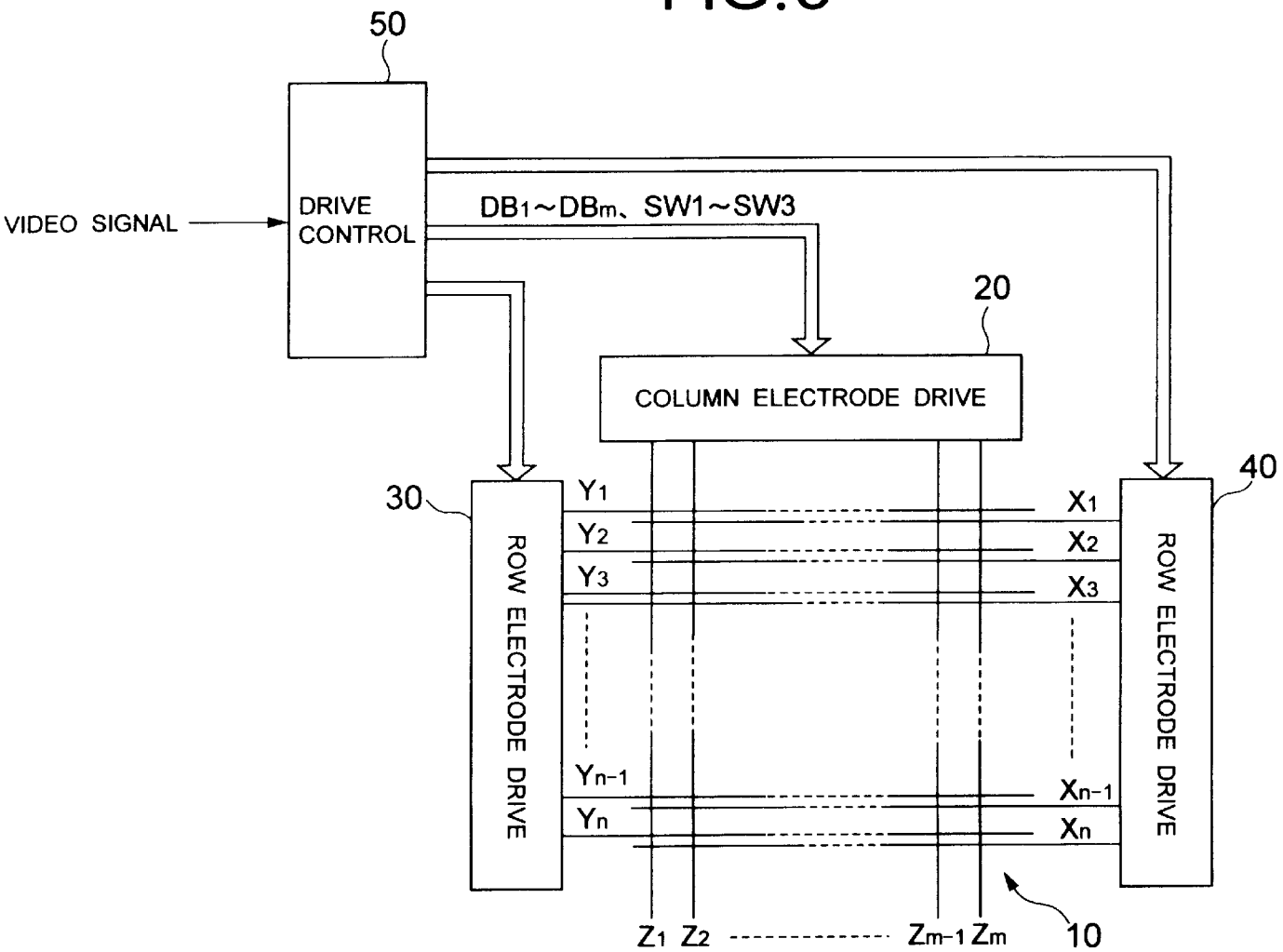
FIG. 3 is a diagram showing a constitution of a plasma display equipped with a drive apparatus of the present invention.

FIG. 3 is a diagram showing the structure of a plasma display apparatus equipped with the drive apparatus according to the present invention.

In FIG. 3, a PDP 10, as the plasma display panel provided with row electrodes Y1 through Yn and row electrodes X1 through Xn, that respectively constitute a row electrode pair corresponding to each line (the first display line through an n-th display line) in PDP 10 with respective pairs of row electrodes X and Y. Furthermore, the PDP 10 is provided with column electrodes Z1 through Zm that cross said row electrodes pairs at right angles, and correspond to each columns (the first column through the m-th column) of one screen with a dielectric layer and a discharge space which are not shown in the figure. The discharge cells which carry display pixels are formed at intersecting portions each of which are formed by a row electrode pair (X, Y) and a column electrodes Z.

Figure 1:
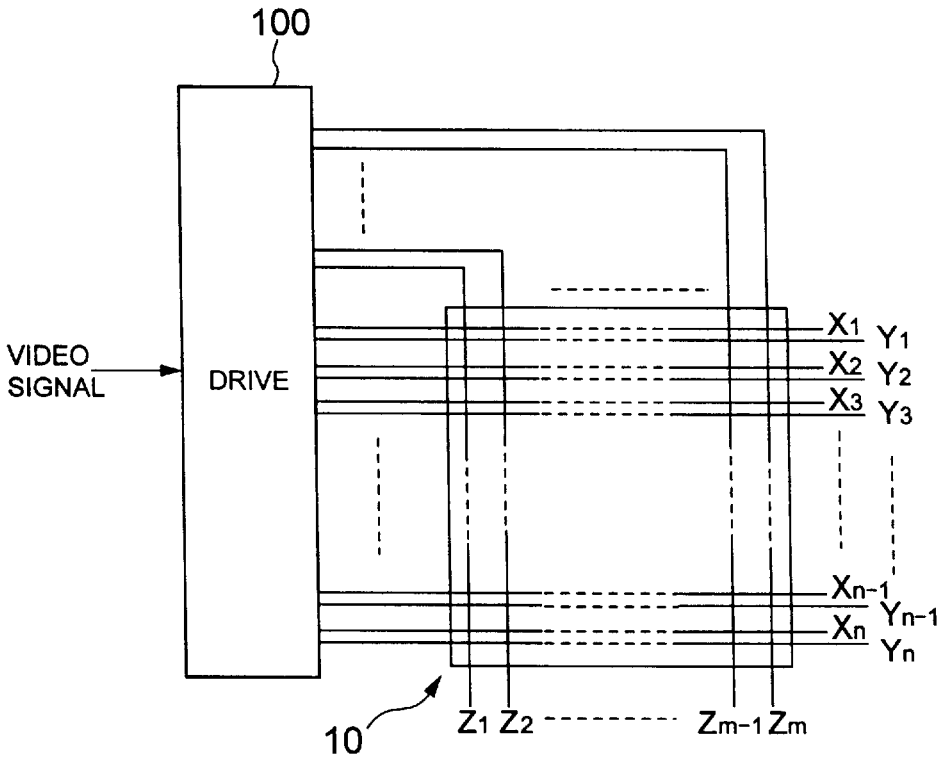
PRIOR ART FIG. 1
FIG. 1 is a view schematically showing a structure of a plasma display using a plasma display panel as a display panel.
Figure 2:
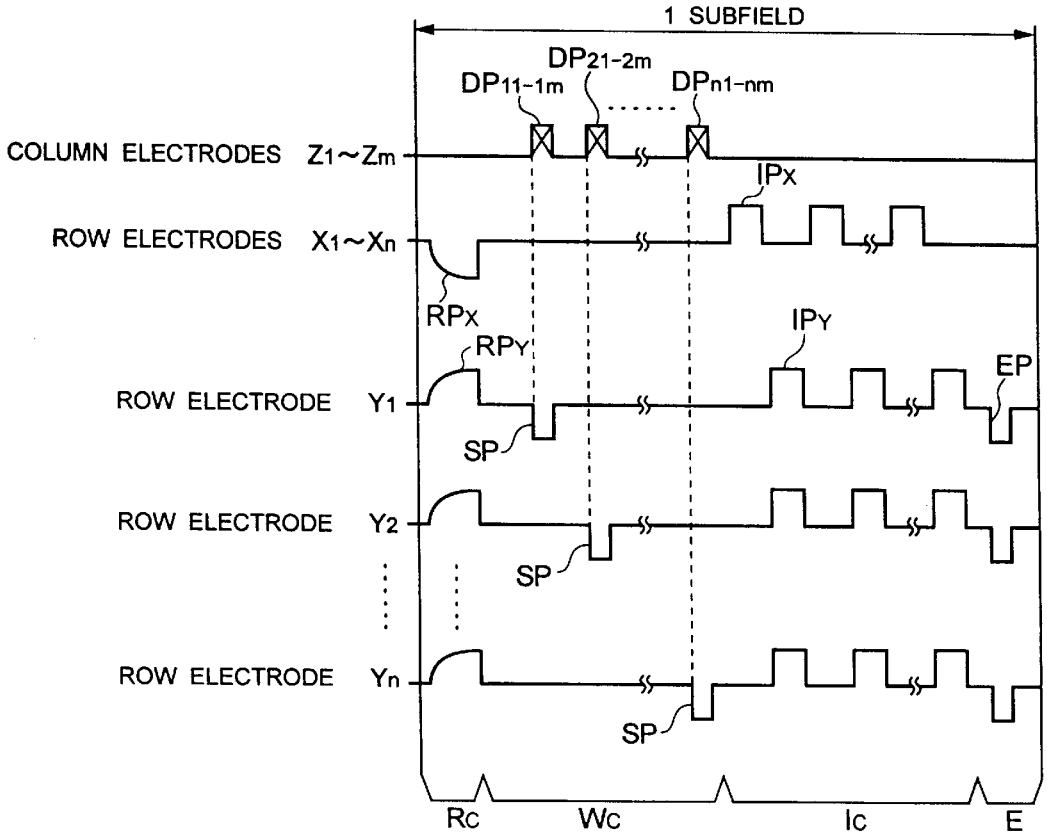
PRIOR ART FIG.2
FIG. 2 is a diagram showing application timings of various drive pulses to PDP 10 in 1 subfield.

The drive control circuit 50 generates various timing signa ls for generating the reset pulses RPx and RPy, scanning pulse SP, and sustaining pulses IPx and IPy shown in FIG. 2, and supplies them to each of the row electrode drive circuits 30 and 40. In accordance with these timing signals, the row electrode drive circuit 30 generates the reset pulse RPx and the sustain pulse IPx, and applies them to the row electrodes X1–Xn of the PDP 10 at the timings shown in FIG. 2. The row electrode drive circuit 40, on the other hand, generates the reset pulse RPy, scanning pulse SP, sustaining pulse IPy, and erasure pulse EP in accordance with various timing signals supplied by the drive control circuit 50, and applies them to the row electrodes Y1 to Yn of the PDP 10 at the timings shown in FIG. 2.

Figure 4:
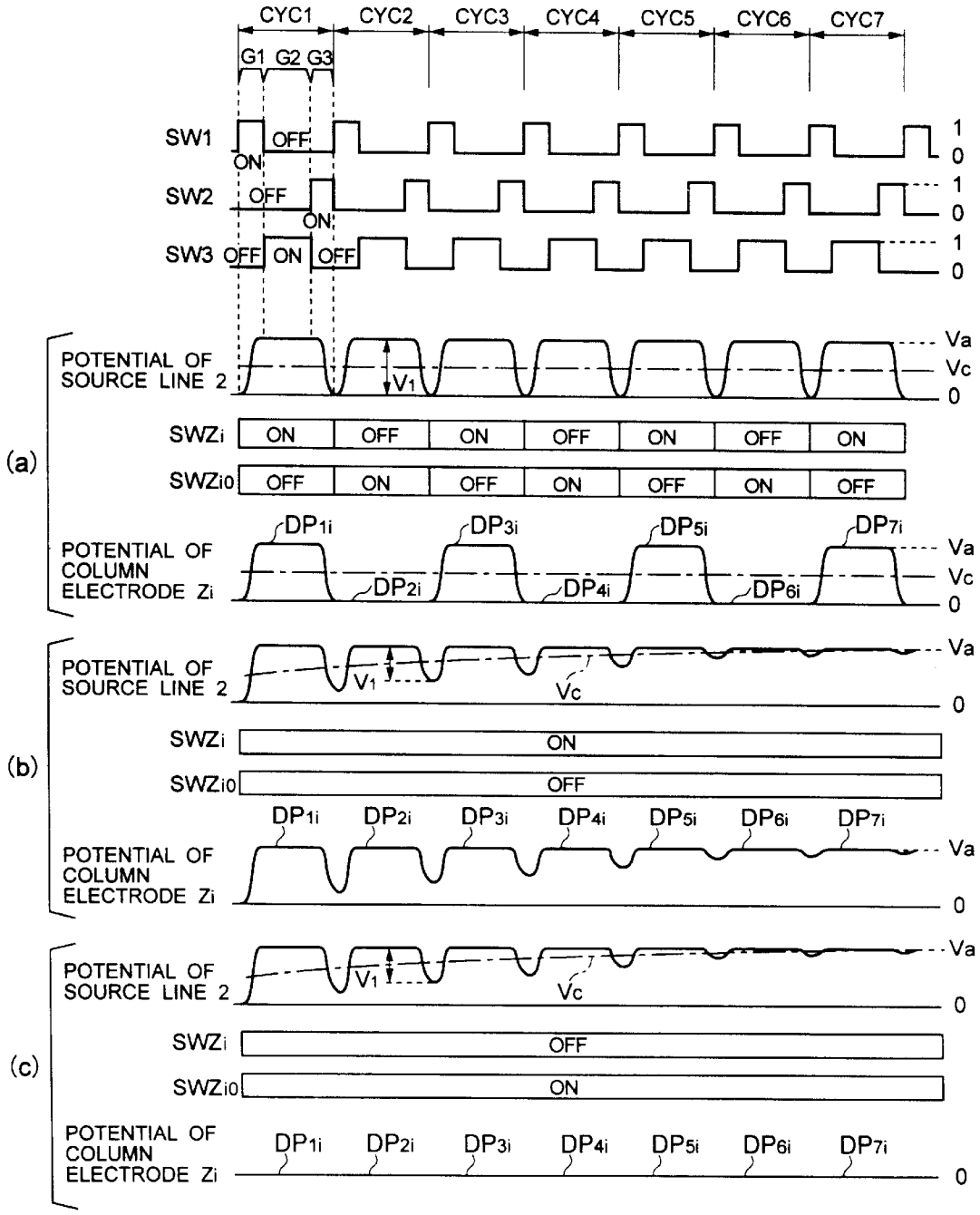
FIG. 4 is a diagram showing inner operation of a column electrode drive 20 as a drive apparatus of the present invention.

The drive control circuit 50 further has an operation to convert the incoming video signal to the 8-bit pixel data, for example, for each of the pixels. Then, the drive control circuit 50 divides the pixel data, for each bit digit, to obtain pixel data bits DB. The drive control circuit 50 extracts, among the bits of a same bit digit, pixel data bits DB1 to DBm respectively correspond to the first to m-th columns belonging to one row, for each of the rows, and supplies the extracted data bits to the column electrode drive circuit 20. During these processes the drive control circuit 50 generates switching signals SW1 to SW3 as shown in FIG. 4, and supplies them to the column electrode drive circuit 20. More particularly, the drive control circuit 50 the switching signals SW1 to SW3 that respectively have the following logical levels:

in the driving step G1,

SW1="1",

SW2="0",

SW3="0";

in the driving step G2,

SW1="0",

SW2="0",

SW3="1"; and in the driving step G3,

SW1="1",

SW2="1",

SW3="0".

The drive control circuit 50 repetitively supplies the switching signals SW1 to SW3 which vary in the manner described above, to the column electrode drive circuit 20, with the above described driving steps G1 to G3 being selected as one cycle.

Figure 5:
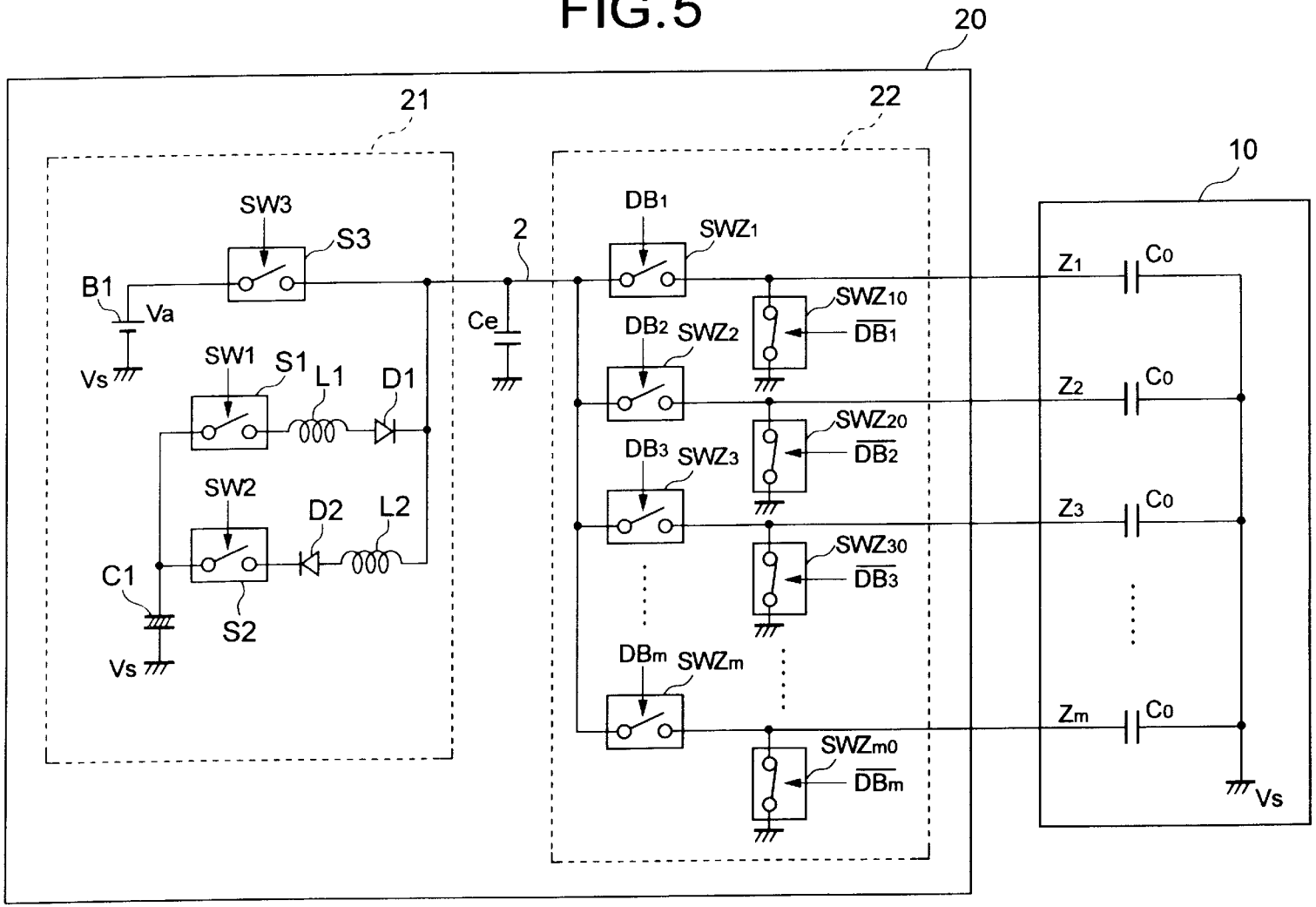
FIG. 5 is a diagram showing inner constitution of a column electrode drive 20 as a drive apparatus of the present invention.

FIG. 5 is a diagram showing the structure of the column electrode driver 20.

As shown in FIG. 5, the column electrode driver 20 is constituted by a power supply circuit 21 that generates a resonation pulse power supply potential having a predetermined amplitude and applies it on a power supply line 2, and a pixel data pulse generating circuit 22 that generates the pixel data pulses based on the resonation pulse power supply potential.

The power supply circuit 21 includes a capacitor C1 a terminal of which is connected to a PDP ground potential Vs that functions as a ground potential of the PDP 10. A switching element S1 is set at an off state while the switching signal SW1 of the logical level "0" is supplied from the drive control circuit 50 mentioned above. When, conversely, the logical level of the switching signal SW1 is "1", the switching element S1 turns on, to apply a potential produced at the other terminal of the capacitor C1 described above to the power supply line 2 via a coil L1 and a diode D1. A switching element S2 is set at an off-state while the switching signal of the logical level "0" is supplied from the drive control circuit 50 mentioned above. When the logical level of the switching signal SW2 is "1", the switching element S2 is set at an on state, to supply the potential at the power supply line 2 mentioned above to the other terminal o the capacitor C1 via the coil L2 and the diode D2. In this process, the capacitor C1 is charged by the potential at the power supply line 2 described above. A switching element S3 is set at the off-state when the switching signal SW3 of the logical level "0" is supplied from the drive control circuit 50 described above. When the logical level of the switching signal SW3 is "1", the switching element S3 is set at the on-state, so that a power supply potential Va by a direct current power supply B1 is applied on the power supply line 2. The direct current power supply B1 has a negative side terminal which is grounded at the PDP grounding potential Vs.

By the operation of the drive circuit 21 described above, the a resonation pulse power supply potential having a resonation amplitude V1 of which the maximum potential is set at the power supply potential Va described above. The pixel data pulse generating circuit 22 is provided with switching elements SWZ1 to SWZm, and switching elements SWZ10 to SWZm0 which are separately on-off controlled in accordance with each of the m pixel data bits DB1–DBm for one line which are supplied from the drive control circuit 50. Each of the switches SWZ1 to SWZm is set at the on-state only when the pixel data bit DB supplied respectively thereto has the logical level "1", to apply the above-described resonation pulse power supply potential which is applied on the power supply line 2 to each of the column electrodes Z1 to Zm of the PDP 10. Each of the switches SWZ10 to SWZm0, conversely, is set at the on-state only when the pixel data bit DB supplied respectively thereto has the logical level "0", to ground the potential on each of the column electrodes Z to the ground potential Vs.

The operation inside the column electrode drive circuit 20 having the structure shown in FIG. 5 will be explained by referring to portions (a) to (c) of FIG. 4. In FIG. 4 operation of the supplication of the pixel data pulses DP of the first to seventh lines in the i-th (i is a number selected from 1 to m) column of the PDP 10 are extracted for the purpose of illustration, and the manner of the change of the potential on the power supply line 2 in the pixel data writing step Wc shown in FIG. 2 is shown in each of the portions (a) to (c).

Particularly, the portion (a) of FIG. 4 corresponds to a case where the bit sequence of the pixel data bit DB corresponding to the first to seventh rows of the i-th column is:

[1, 0, 1, 0, 1, 0, 1], the portion (b) corresponds to a case where the bit sequence of the pixel data bit DB corresponding to the first to seventh rows of the i-th column is:

[1, 1, 1, 1, 1, 1, 1], and the portion (c) corresponds to a case where the bit sequence of the pixel data bit DB corresponding to the first to seventh rows of the i-th column is:

[0, 0, 0, 0, 0, 0, 0].

First, when the bit sequence of the pixel data bit DB corresponding to the first to seventh rows of the i-th column is [1, 0, 1, 0, 1, 0, 1], the switching elements SWZi and SWZi0 repeat, as shown in the portion (a) of FIG. 4, an alternation between the on-state and the off-state.

In this state, only the switching element S1 is set at the on-state among the switching elements SW1 to SW3 in the driving step G1, so that the electric charge having been stored in the capacitor C1 is discharged. In the first cycle CYC1 shown in FIG. 4, since the switching element SWZi is set at the on-state, the discharge current associated with the above-described discharge flows into the column electrode Zi of the PDP 10 via the switching element S1, coil L1, diode D1, power supply line 2, and the switching element SWZi. In this state, the parasitic load capacitance of the column electrode Zi is charged, so that an electric charge takes place in the load capacitance C0. In association with the discharge of the capacitor C1 described above, the potential on the power supply line 2 gradually rises owing to a resonation operation by the coil L1 and the load capacitance C0. Then, the potential on the power supply line 2 reaches, as shown in the portion (a) of FIG. 4, the potential Va that is twice the potential Vc at one terminal of the capacitor C1. The gradual rise of the potential on the power supply line 2 described above forms a front edge part of the resonation pulse power supply potential described above.

In the first cycle CYC1, the front edge part of the resonation pulse power supply potential described above directly forms a front edge part of the pixel data pulse DP1i to be applied to the column electrode Zi as illustrated in the portion (a) of FIG. 4.

Then, the driving step G2 is performed, only the switching element S3 is turned on among the switching elements S1–S3. Then, the DC potential $V_a$ is applied from the DC power source B1 to the power source line 2 through the switching element S3. At this moment, the above potential $V_a$ becomes a maximum potential of the above resonant pulse potential. During the first cycle CYC1, the maximum potential of the resonant pulse potential (potential $V_a$) becomes a maximum potential of the pixel data pulse $DP_{1i}$ applied to the row electrode $Z_i$, as shown in FIG. 4(*a*). At this moment, a current flow flows through the row electrode Zi. Then, the parasitic load capacitance $C_0$ of the row electrode Zi is charged to store electric charge.

Then, when the driving step G3 is performed, only the switching element S2 is turned on among the switching elements S1–S3. Then, the load capacitance $C_0$ of the PDP 10 starts a discharge. The discharge causes a current flow to flow into the capacitor C1 through the row electrode $Z_i$, the switching element $SWZ_i$, the power source line 2, the coil L2, the diode D2, and the switching element S2. In other words, electric charge stored in the load capacitance $C_0$ of the PDP 10 is recovered to the capacitor C1 provided in the power source 21. At this moment, the potential of the power source line 2 decreases gradually due to a time constant defined by the coil L2 and the load capacitor $C_0$, as shown in FIG. 4(*a*). At this time, the gradually-decreasing potential of the power source line 2 described above becomes a rear edge of the above resonant pulse potential. In addition, in the first cycle CYC1, the rear edge of the resonant pulse potential described above becomes a rear edge of the pixel data pulse $DP_{1i}$ applied to the row electrode $Z_i$, as shown in FIG. 4(*a*).

After the driving step G3 is over, an operation comprising the driving steps G1–G3 is repeated in each of the second to seventh cycles CYC2–CYC7.

Referring to FIG. 4(*a*), the switching element $SWZ_i$ is turned off during each of the second cycle CYC2, the forth cycle CYC4, and the sixth cycle CYC6. Therefore, a lower voltage (0V) is applied to the row electrode $Z_i$ as each of pixel data pulses $DP_{2i}$, $DP_{4i}$, and $DP_{6i}$ corresponding to the second, forth, and sixth rows, respectively. In addition, in these even-numbered cycles CYC, the switching element $SWZ_{i0}$ is turned on. Then, all electric charge remaining in the load capacitor $C_0$ of the PDP 10 is recovered through a current path including the row electrode $Z_i$ and the switching element $SWZi_{i0}$. Accordingly, when the second cycle CYC2 is over and the switching element $SWZ_i$ is switched from an OFF condition to an ON condition just after a start of the next third cycle CYC3, the potential of the power source line 2 becomes substantially zero, as shown in FIG. 4(*a*).

In other words, when the pixel data bits DB for a given column has a bit series in which a bit for each row is reversed every two rows, such as [1, 0, 1, 0, 1, 0, 1], a resonant pulse potential having a resonant amplitude $V_1$ at the maximum potential $V_a$ as shown in FIG. 4(*a*) is applied to the power source line 2.

On the other hand, when a data pixel data bits DB for a given column has a bit series in which a bit for each row has a logical level of "1" in series, such as [1, 1, 1, 1, 1, 1, 1], the switching element $SWZ_i$ maintains an ON condition and the switching element $SWZ_{i0}$ maintains an OFF condition, as shown in FIG. 4(*b*). In other words, during the above duration, electric charge is not recovered through a current path including the row electrode $Z_i$ and the switching element $SWZ_{i0}$, which is different from the situation shown in FIG. 4(*a*). Accordingly, electric charge which has not recovered during the driving step G3 of each cycle CYC is gradually stored to the load capacitor $C_0$ of the PDP 10. As a result, the resonant pulse potential applied to the power source line 2 decreases the resonant amplitude $V_1$ gradually with maintaining the maximum potential $V_a$ thereof. The resultant resonant pulse potential is then applied to the row electrode $Z_i$ as pixel data pulses $DP_{1i}$–$DP_{7i}$ having a higher voltage.

In other words, when each of pixel data bits for a given column has a logical levels of "1" for each row in series, a voltage to be applied to each row electrode Z is not required to be pulsed. Therefore, in such a case, the resonant amplitude of the resonant pulse potential to be applied to the power source line 2 is decreased with maintaining the maximum potential $V_a$ thereof. Accordingly, at this time, charge and discharge accompanied with the above resonance is not performed, so that a reactive power is restricted.

In addition, when the pixel data bits DB for a given column has a bit series in which a bit for each row has a logical levels of "0", such as [0, 0, 0, 0, 0, 0, 0, 0], the switching element $SWZ_i$ maintains an OFF condition and $SWZi_{i0}$ maintains an ON condition. At this time, during the driving step G1, electric charge stored in the capacitor C1 is discharged, similar to the case shown of FIG. 4(*a*). With this discharge, a potential $V_c$ appearing at an end of the capacitor C1 increases gradually due to a resonance caused by the parasitic capacitance $C_e$ of the coil L1 and the power source line 2, as shown in FIG. 4(*c*). A final potential applied to the power source line 2, then, reaches a potential $V_a$ having twice potential Vc described above. At this time, a gradually-rising potential to the power source line 2 described above becomes a front edge of the resonant pulse potential. Then, when the driving step G2 is performed, a potential $V_a$ from the DC power source Ba is applied over the power source line 2 through the switching element S3. At this time, the parasitic capacitance $C_e$ of the power source line 2 is charged to store electric charge. It should be noted that the above potential $V_a$ becomes a maximum potential of the resonant pulse potential. Then, when the driving step G3 is performed, the parasitic capacitance $C_e$ starts a discharge. Electric charge stored in the parasitic capacitance $C_e$ is then recovered to the capacitor C1 provided in the power source 21. At this time, the potential of the power source line 2 decreases gradually due to a time constant defined by the coil L2 and the parasitic capacitance $C_e$, as shown in FIG. 4(*c*). On the other hand, electric charge which has not been recovered during the driving step G3 of each of cycles is gradually stored to the parasitic capacitance $C_e$. Therefore, the resonant pulse potential applied to the power source line 2 decreases the resonance amplitude $V_1$ gradually with maintaining the maximum potential $V_a$ thereof.

In other words, when pixel data bits for a given column has a logical level of "0" in series for each row, a potential to be applied to the power source line 2 is not required to be pulsed. Therefore, in this case, the potential of the power source line 2 is rectified to a substantial direct current (maintained at the potential $V_a$) with restricting an amplitude change in the resonant pulse potential to be applied to the power source line 2. Accordingly, charge and discharge accompanied with the resonance described above is not performed, so that a reactive power is restricted.

In the arrangement shown in FIG. 5, the resonant amplitude $V_1$ of the resonant pulse potential is decreased gradually, as shown in FIGS. 4(*b*) and 4(*c*). In another embodiment, if such a pattern of pixel data bits as the above described is detected, a resonant amplitude of the resonant pulse potential may be immediately decreased.

Figure 6:
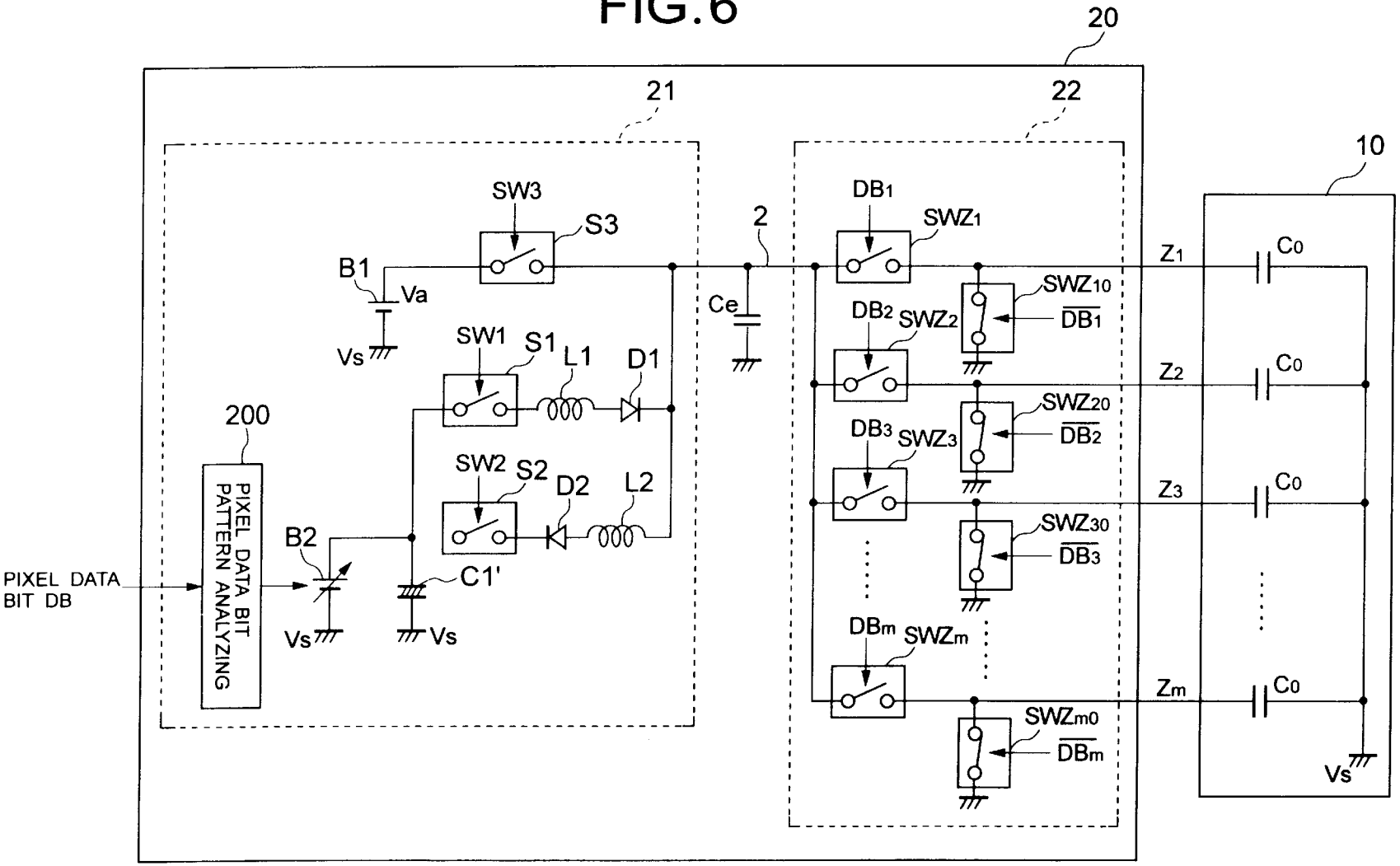
FIG. 6 is a diagram showing other constitutions of a column electrode drive 20.

FIG. 6 shows a row electrode driver 20 of another embodiment to solve the above problem. FIG. 6 shows an internal structure of the row electrode driver.

The row electrode driver 20 in FIG. 6 comprises a pixel data bit pattern analyzer 200 and a variable voltage power source B2. The row electrode driver 20 has the same structure as the driver of FIG. 5 except replacing the capacitor Cl with another capacitor C1'. The capacitor C1' has a considerably smaller capacitance than that of the capacitor C1.

Referring to FIG. 6, the pixel data bit pattern analyzer 200 receives pixel data bits $DB_1$–$DB_m$ for each column supplied from the driving controller 50 to analyze a bit pattern with respect to a row and a column on the basis of the received data bits. The pixel data bit pattern analyzer 200 then produces a voltage control signal based on the analyzed result to supply the voltage control signal to the variable voltage power source B2.

Figure 7:
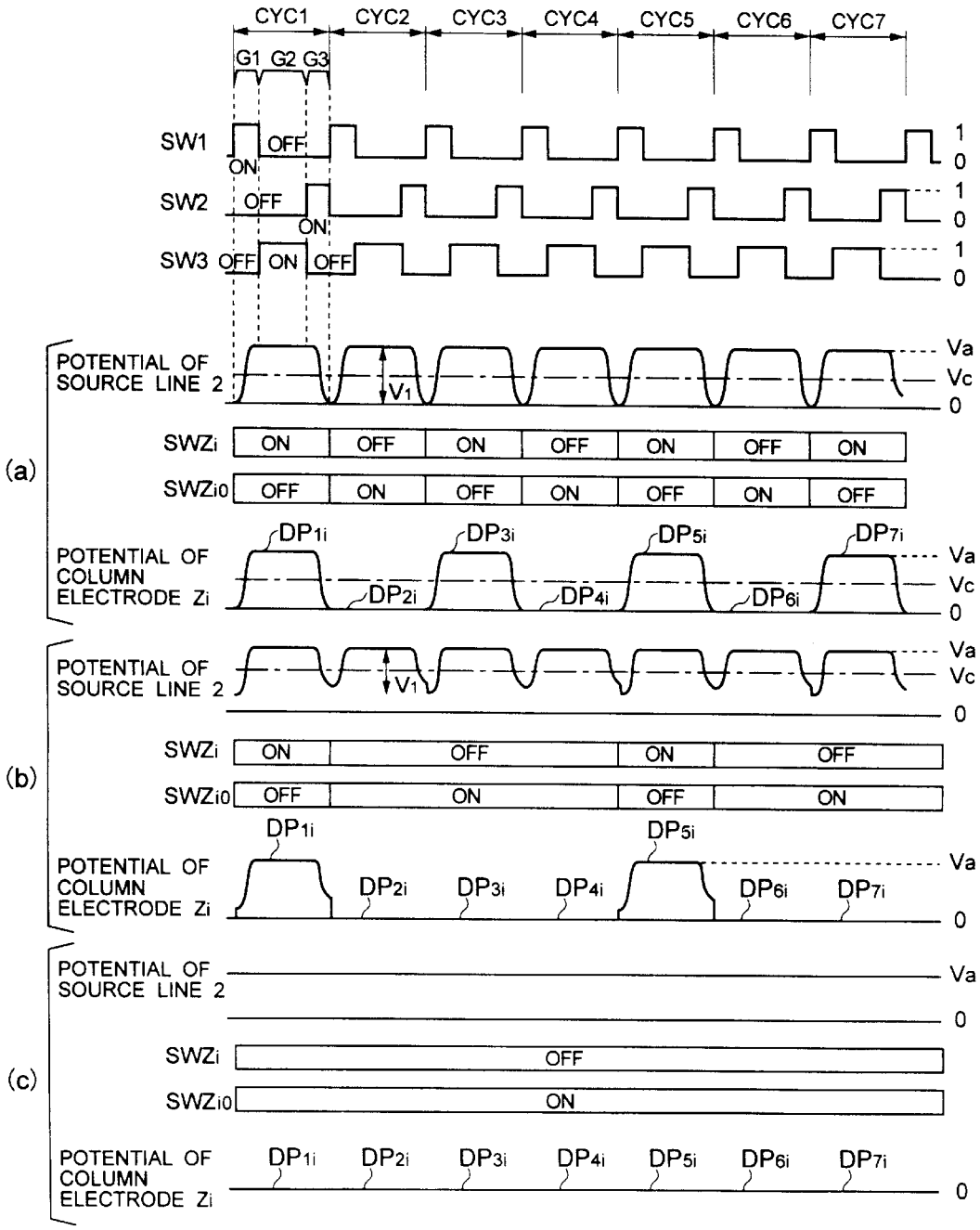
FIG. 7 is a diagram showing inner operation in a column electrode drive 20 shown in FIG. 6.

The pixel-data bit-pattern analyzing circuit 200, for example, supplies a voltage control signal to the variable voltage source B2 to generate a voltage Vv (Vv=0.5*Va) when the logical levels of the supplied pixel-data bits DB alternately change every line. In this instance, a resonant pulse potential having a resonant amplitude $V_1$ and a maximum potential Va is applied to the power source line 2 as shown in (*a*) of FIG. 7, since the column electrode driving circuit 20 shown in FIG. 6 has substantially the same configuration as that shown in FIG. 5.

On the other hand, the pixel-data bit-pattern analyzing circuit 200 supplies a voltage control signal to the variable voltage source B2 to generate a voltage Vv (0.5*Va<Vv<Va) responsive to the number of the consecutive pixel-data bits DB having the same logical level, when the supplied pixel-data bits DB consecutively have the same logical level in the column direction. Accordingly, the potential of one terminal of the capacitor C1' is fixed to the voltage Vv. Therefore, a resonant pulse potential in which the resonant amplitude $V_1$ is decreased by an amplitude according to the potential Vv is applied to the power source line 2 as shown in (*b*) of FIG. 7, while the maximum potential Va is maintained. In this instance, the pixel-data bit-pattern analyzing circuit 200 supplies a voltage control signal to the variable voltage source B2 to generate a voltage Va, when more than a predetermined number of the consecutive pixel-data bits DB (e.g., more than seven consecutive pixel-data bits) have the same logical level in the column direction. Accordingly, the resonant amplitude $V_1$ becomes zero and a direct current potential Va is applied to the power source line 2 as shown in (*c*) of FIG. 7.

It should be noted that the capacitor C1' can be eliminated in the configuration shown in FIG. 6, since the variable voltage source B2 is able to play the role of the capacitor C1'.

The following problem may arise when the bit sequence in the column direction of the pixel-data bits DB has the consecutive logical levels of "1" (i.e., logical level inducing the selective discharge).

In this instance, the resonant amplitude becomes zero as the potential of the capacitor C1' gradually increases. As a result, the potential of the power source line 2 is fixed to the potential Va of the power source B1 (i.e., direct current driving). Thus, most of the columns of the PDP 10 include the bit sequences of consecutive logical levels of "1". When displaying a special picture having a bit sequence of [1, 0, 1, 0, . . . , 1, 0] in a portion, the direct current potential Va is applied to the column electrode $Z_i$ corresponds to the bit sequence [1, 0, 1, 0, . . . , 1, 0] as shown in (*a*) of FIG. 8. Therefore, the column electrode $Z_i$ is DC driven to cause a great electric dissipation.

Figure 9:
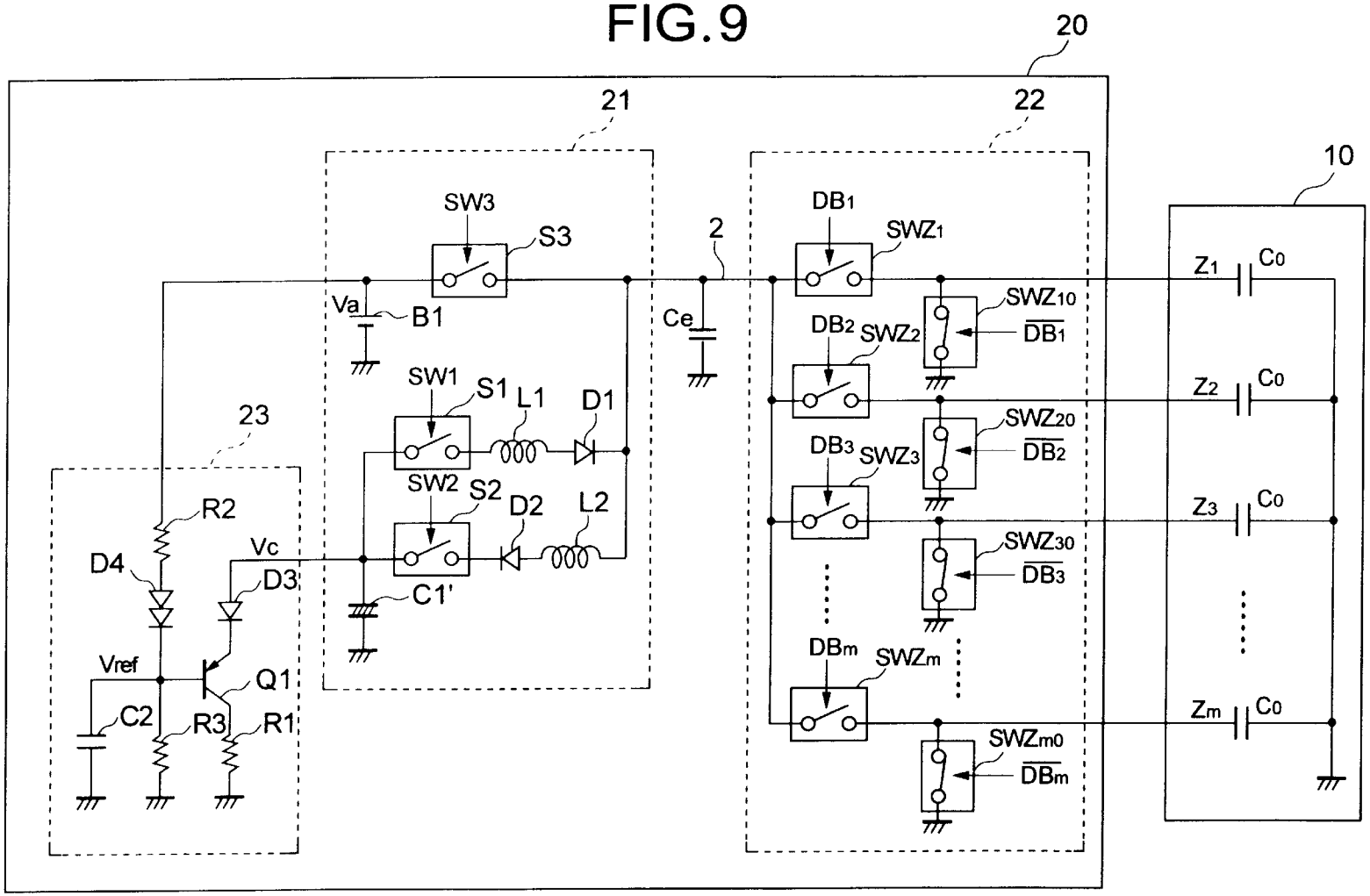
FIG. 9 is a diagram showing other constitutions of a column electrode drive 20.

FIG. 9 illustrates an another configuration of the column electrode driving circuit 20 to overcome the above-described problem.

The configuration of the column electrode driving circuit 20 shown in FIG. 9 is similar to that shown in FIG. 5 except that a clamping circuit 23 is provided. A description will be made mostly for the operation of the clamping circuit 23.

FIG. 9 shows another row electrode driving circuit 20 constructed to solve such a problem.

The components of the row electrode driving circuit 20 shown in FIG. 9 are the same as those shown in FIG. 5 except a clamping circuit 23. Thus the operation of the clamping circuit 23 is mainly described below.

The clamping circuit 23 is constructed of a transistor Q1, resistors R1–R3, capacitor C2, and diodes D3 and D4. Potential Vc at one terminal of the capacitor C1' is applied via the diode D3 to the emitter terminal of the transistor Q1. Ground potential Vs of PDP is applied via the resistor R1 to the collector terminal of the transistor Q1. In addition, the potential Va of the power supply B1 is applied via the resistor R2 and the diode D4 to the base terminal of the transistor Q1. Further, the particular base terminal is connected to the resistor R3 and the capacitor C2 which are grounded at the ground potential Vs of PDP. Therefore, the potential Va of the power supply B1 is divided by the resistors R2 and R3, so that a reference potential Vref is generated. Thus, the reference potential Vref is applied to the base terminal of the transistor Q1.

In addition, the reference potential Vref is previously set within the following range.

(Va/2)<Vref<Va

Figure 8:
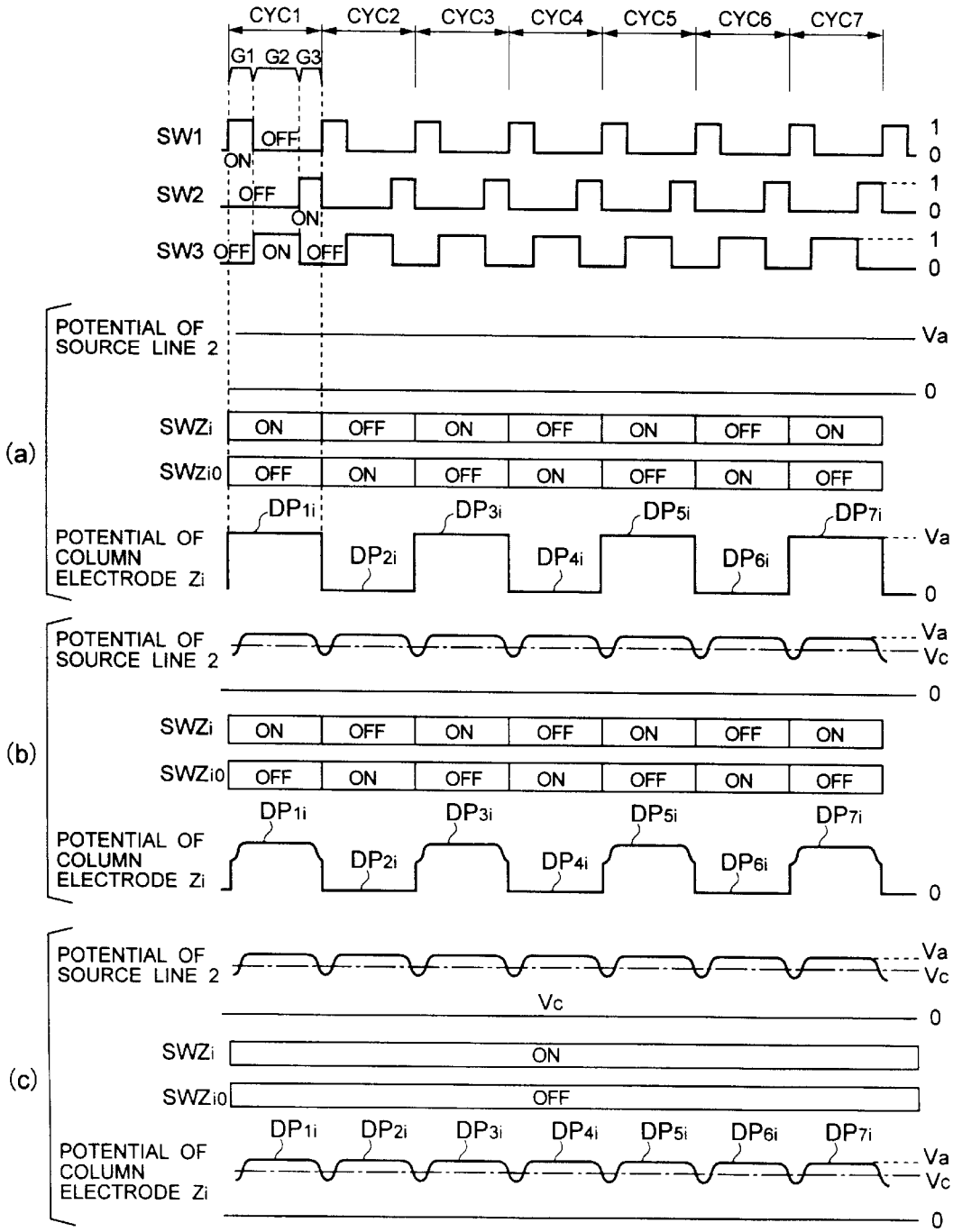
FIG. 8 is a diagram showing one of the other inner operations in a column electrode drive 20.

In such a configuration, if the potential Vc of the capacitor C1' exceeds the reference potential Vref, then the transistor Q1 becomes ON state to clamp the potential Vc of the capacitor C1' to the reference potential Vref. That is, the clamping circuit 23 prevents from vanishing resonance amplitude in the power supply circuit 21 by the clamping of the potential of the capacitor C1' to the reference potential Vref. According to the operation of the clamping circuit 23, the potential variations of the power supply line 2 have little resonance amplitudes as shown in FIG. 8(*b*) and FIG. 8(*c*). Therefore, dissipation of electric power is compressed in comparison with the driving operation shown in FIG. 8(*a*), since the capacitor C1' collects electric charges.

In addition, the clamping circuit 23 shown in FIG. 9 always preforms the clamping operation above mentioned. The clamping operation of the clamping circuit 23 may be stopped other than necessity.

Figure 10:
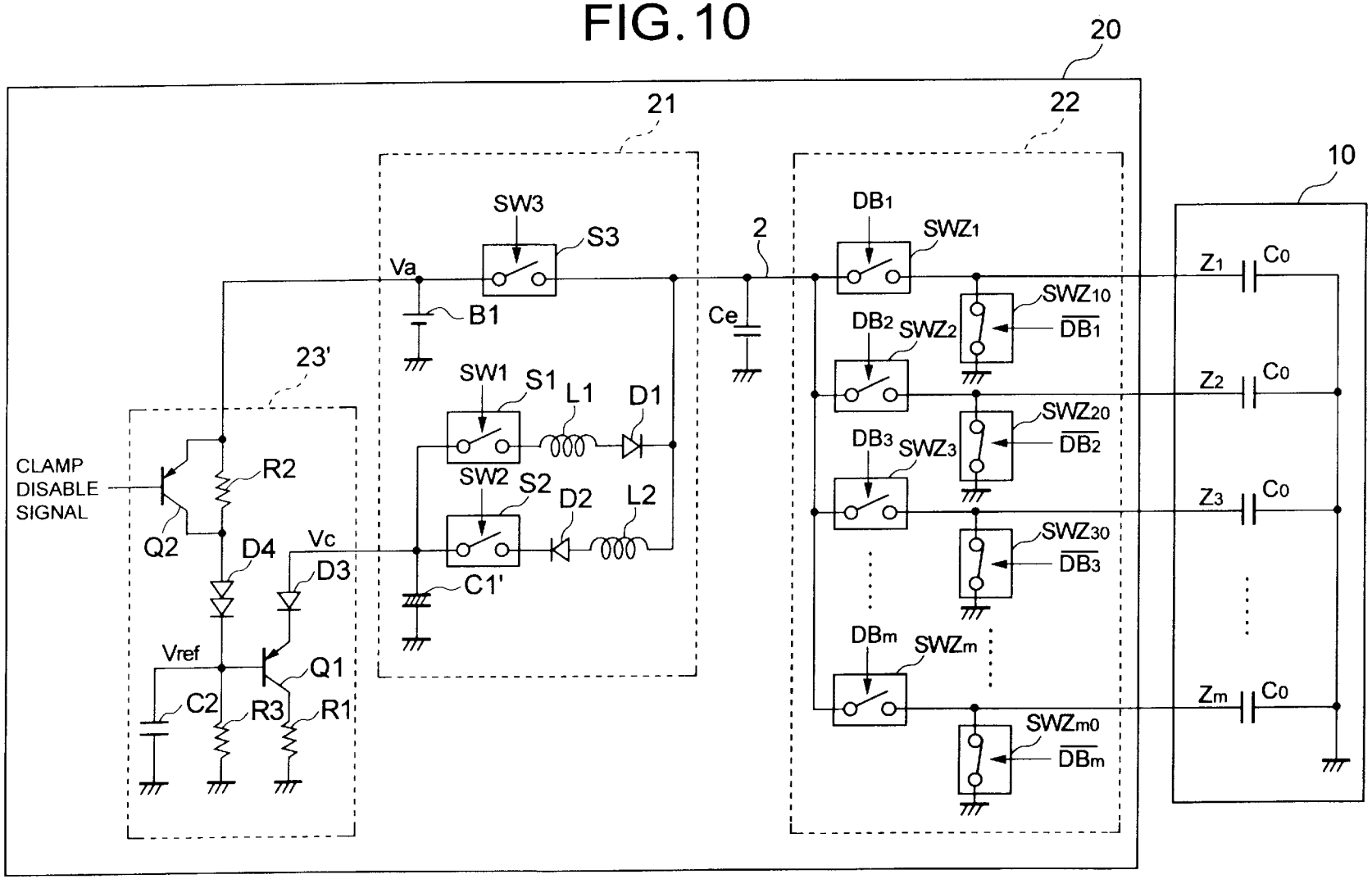
FIG. 10 is a diagram showing a modification of a column electrode drive 20.

FIG. 10 shows another clamping circuit 23' constructed for such a condition.

The clamping circuit 23' is constructed by adding a transistor Q2 to the clamping circuit 23 shown in FIG. 9. The emitter and collector terminals of the transistor Q2 are connected to both terminals of the resistor R2. The clamping disable signal is supplied to the base terminal of the transistor Q2. The transistor Q2 is kept in OFF state while the clamping disable signal having a low voltage is supplied from the drive control circuit 50. In this case, the clamping circuit 23' is an equivalent circuit to the clamping circuit 23, so that the clamping operation mentioned above is carried out. On the other hand, while a high voltage of the clamping disable signal is supplied from the drive control circuit 50, transistor Q2 becomes ON state to establish a shirt-circuit between both the terminals of the resistor R2. Therefore, the potential of the base terminal of the transistor Q1 becomes equal to the potential Va, so that the transistor Q1 enters to stop the clamping operation of the clamping circuit 23'.

Nothing of possibility to display the special picture as above mentioned when inputting a target date for images including pictures has a correlation in row and line directions within one scene such as television signals. Thus, the drive control circuit 50 distinguishes classification of the video signals on the basis of the input video signals. When judging that the input video signal is a television signal, the drive control circuit 50 supplies a clamping disable signal of a high voltage to the clamping circuit 23' to stop the clamping operation. On the other hand, When judging that the input video signal is a video signal for displaying the special picture carrying picture, figure or graph and the like, such as a graphic video signals, the drive control circuit 50 supplies the clamping disable signal of a low voltage to the clamping circuit 23' to preform the clamping operation. By those operations, excessive dissipation of electric power occurring while displaying the special picture as above mentioned is prevented.

Being apparent from the above, a display panel drive apparatus according to the present invention causes the resonance amplitude of the resonance pulse voltage source potential to be small while keeping the maximum level of the amplitude constant, when at least two of the supplied pixel data neighboring each other assume the same logic values as each other in the column direction.

Therefore, the display apparatus according to the present invention can suppress unwanted charge and discharge operations for causing the resonance pulse voltage source potential to change thereby to reduce power consumption.

This application is based on Japanese Patent Applications Nos. 2000-273205 and 2001-197797 which are hereby incorporated by reference.

What is claimed is:

1. A drive apparatus for driving a display panel having a plurality of row electrodes and a plurality of column electrodes intersecting with said row electrodes to form capacitive light-emitting elements, by applying pixel data to said column electrodes while successively applying scan pulses to said row electrodes said pixel pulses each representing a pixel data based on an input video signal, which comprises:

a voltage source circuit for generating a resonance pulse source potential having a resonance amplitude variable to have a maximum potential level at a first predetermined potential and supplying the generated resonance pulse source potential to a voltage source line; and a picture element data pulse generating circuit for generating said pixel data on by connecting said voltage source line with either ones of said column electrodes in accordance with said picture element data so as to cause said picture data pulse to appear on said either one of the column electrodes, said voltage source circuit causing said resonance amplitude to decrease while keeping said maximum potential at said first predetermined potential when at least two of said pixel data neighboring each other in the column direction have the same logical value.

2. A drive apparatus according to claim 1, in which said voltage source circuit causes said resonance amplitude to decrease by such an amount proportionate to a number of neighboring pixel datas having the same logical values.

3. A drive apparatus according to claim 1, in which said voltage source circuit includes a capacitor having one terminal thereof grounded, a first switching element and a first coil serially connected with each other between the other terminal of said capacitor and said voltage source line, a second switching element and a second coil serially connected with each other between the other terminal of said capacitor and said voltage source line, a DC voltage source generating a first potential, and a third switching element connected between said DC voltage source and said voltage source line, said pixel data pulse generating circuit includes fourth switching elements for connecting said voltage source line with either ones of said column electrodes in accordance with a logical value of said pixel data, and fifth switching elements for grounding either one of said column electrodes in accordance with an inverse value of said pixel data.

4. A drive apparatus according to claim 1, which periodically and repeatedly performs a switch drive sequence having a first drive step for causing only said first switching element to be ON, a second drive step for causing only said third switching element to be ON, and a third drive step for causing said second switching element to be ON.

5. A drive apparatus for driving a display panel having a plurality of row electrodes and a plurality of column electrodes intersecting with said row electrodes to form capacitive light-emitting elements, by applying pixel data to said column electrodes while successively applying scan pulses to said row electrodes said pixel pulses each representing a pixel data based on an input video signal, which comprises:

a voltage source circuit including a capacitor having one terminal thereof grounded, a first switching element and a first coil serially connected to each other between the other terminal of said capacitor and said voltage source line, a second switching element and a second coil connected serially to each other between the other terminal of said capacitor and said voltage source line, a DC voltage source for generating said first potential, a third switching element connected between said DC voltage source and said voltage source line, and a variable voltage source for exerting onto other terminal of the capacitor a potential variable with a number of the pixel datas which are neighboring each other in the column direction and have the same logic values as each other; and a pixel data pulse generating circuit including fourth switching elements for connecting said voltage source line and either ones of said column electrodes in accordance with the a logic value of said pixel data, and fifth switching elements for grounding either ones of said column electrodes of an inverse logic value of said pixel data.

6. A drive apparatus according to claim 5, in which said variable voltage source decreases a potential to be applied to the other terminal of said capacitor when a number of the pixel data neighboring each other and having the same logic values as each other is small and increases that potential when said number is large.

7. A drive apparatus according to claim 5, in which said variable voltage source causes the potential to be applied to the other terminal of said capacitor to vary within a range of from a half of said first potential to said first potential.

8. A drive apparatus according to claim 3, which further comprises:

a clamp circuit for causing the potential of said capacitor to become a predetermined reference potential when the potential of said capacitor exceeds said predetermined reference potential.

9. A drive apparatus according to claim 8, in which said predetermined reference potential is higher than a half of said first potential but lower than said first potential.

10. A drive apparatus according to claim 8, which further comprises:

clamp operation control means for causing said clamp circuit to change its state from an operative state to an inoperative state and vice versa.

11. A drive apparatus according to claim 10, in which said clamp operation control means determines a kind of said input video signal and causes said clamp circuit to change its state from the operative state to the inoperative state and vice versa in accordance with the determination result.

* * * * *